US005899668A

United States Patent [19]

Shenoi et al.

[11] Patent Number: 5,899,668

[45] Date of Patent: May 4, 1999

[54] TWO-STAGE LIQUID RING PUMPS HAVING SEPARATE GAS AND LIQUID INLETS TO THE SECOND STAGE

[75] Inventors: Ramesh B. Shenoi, West Orangeburg, N.Y.; Carl G. Dudeck, Newtown, Conn.

[73] Assignee: The Nash Engineering Company, Trumbull, Conn., CT

[21] Appl. No.: 08/791,508

[22] Filed: Jan. 30, 1997

[51] Int. Cl.[6] ..... F04C 19/00

[52] U.S. Cl. ..... 417/68; 417/69

[58] Field of Search ..... 417/68, 69

[56] References Cited

U.S. PATENT DOCUMENTS

| | | | |
|---|---|---|---|
| 2,178,994 | 11/1939 | Inglis | 417/69 |
| 3,108,738 | 10/1963 | Luhmann . | |
| 3,642,384 | 2/1972 | Huse | 417/69 |
| 3,884,596 | 5/1975 | Hoffmeister | 417/68 |
| 4,132,504 | 1/1979 | Fitch | 417/68 |
| 4,273,515 | 6/1981 | Fitch . | |
| 4,323,334 | 4/1982 | Haavik | 417/68 |
| 4,521,161 | 6/1985 | Olsen et al. | 417/68 |
| 4,685,865 | 8/1987 | Auschrat | 417/68 |
| 5,131,817 | 7/1992 | Pastore, Jr. | 417/69 |

FOREIGN PATENT DOCUMENTS

| | | |
|---|---|---|
| 617521 | 3/1934 | Germany . |
| 823170 | 10/1951 | Germany . |
| 1047981 | 1/1956 | Germany . |
| 1054652 | 4/1959 | Germany . |
| 34411 | 3/1977 | Japan . |
| 691425 | 5/1953 | United Kingdom . |
| 703533 | 2/1954 | United Kingdom . |
| 710611 | 5/1954 | United Kingdom . |
| 858422 | 1/1961 | United Kingdom . |

*Primary Examiner*—Timothy Thorpe
*Assistant Examiner*—Cheryl J. Tyler
*Attorney, Agent, or Firm*—Fish & Neave; Robert R. Jackson

[57] ABSTRACT

A two-stage liquid ring pump has an interstage structure which promotes separation of the gas and liquid discharged from the first stage. The second stage has separate gas and liquid inlets for respectively admitting the separated gas and liquid to the second stage. This avoids any possible choking of the second stage gas inlet by liquid, thereby improving the performance of the pump.

3 Claims, 2 Drawing Sheets

TWO-STAGE LIQUID RING PUMPS HAVING SEPARATE GAS AND LIQUID INLETS TO THE SECOND STAGE

BACKGROUND OF THE INVENTION

This invention relates to liquid ring pumps, and more particularly to liquid ring pumps with two, serially connected, gas pumping stages.

Two-stage liquid ring pumps are well known, as is shown, for example, by Olsen et al. U.S. Pat. No. 4,521,161. In the usual such pump, a mixture of gas and liquid is discharged from the first stage and passed to the inlet of the second stage. The liquid in this mixture is generally needed in the second stage (e.g., to make up for liquid discharged with the gas from the second stage). However, it is believed that the liquid in the mixture coming from the first stage may to some extent choke the second stage inlet, thereby reducing the pressure differential that the pump can achieve, reducing its volumetric capacity, and/or increasing its power requirements.

In view of the foregoing, it is an object of this invention to provide improved two-stage liquid ring pumps.

It is a more particular object of this invention to increase the pressure range and volumetric capacity and to reduce the power requirements of two-stage liquid ring pumps.

SUMMARY OF THE INVENTION

These and other objects of the invention are accomplished in accordance with the principles of the invention by providing two-stage liquid ring pumps in which the interstage structure promotes separation of the gas and liquid discharged from the first stage. Separate inlets are then provided for respectively admitting the separated gas and liquid to the second stage. This avoids any choking of the second stage gas inlet by liquid from the first stage.

Further features of the invention, its nature and various advantages will be more apparent from the accompanying drawings and the following detailed description of the preferred embodiments.

BRIEF DESCRIPTION OF THE DRAWINGS

FIG. 2 is taken from the right in FIG. 1, and FIG. 1 is taken from the left in FIG. 2.

DETAILED DESCRIPTION OF THE PREFERRED EMBODIMENTS

Figure 1:
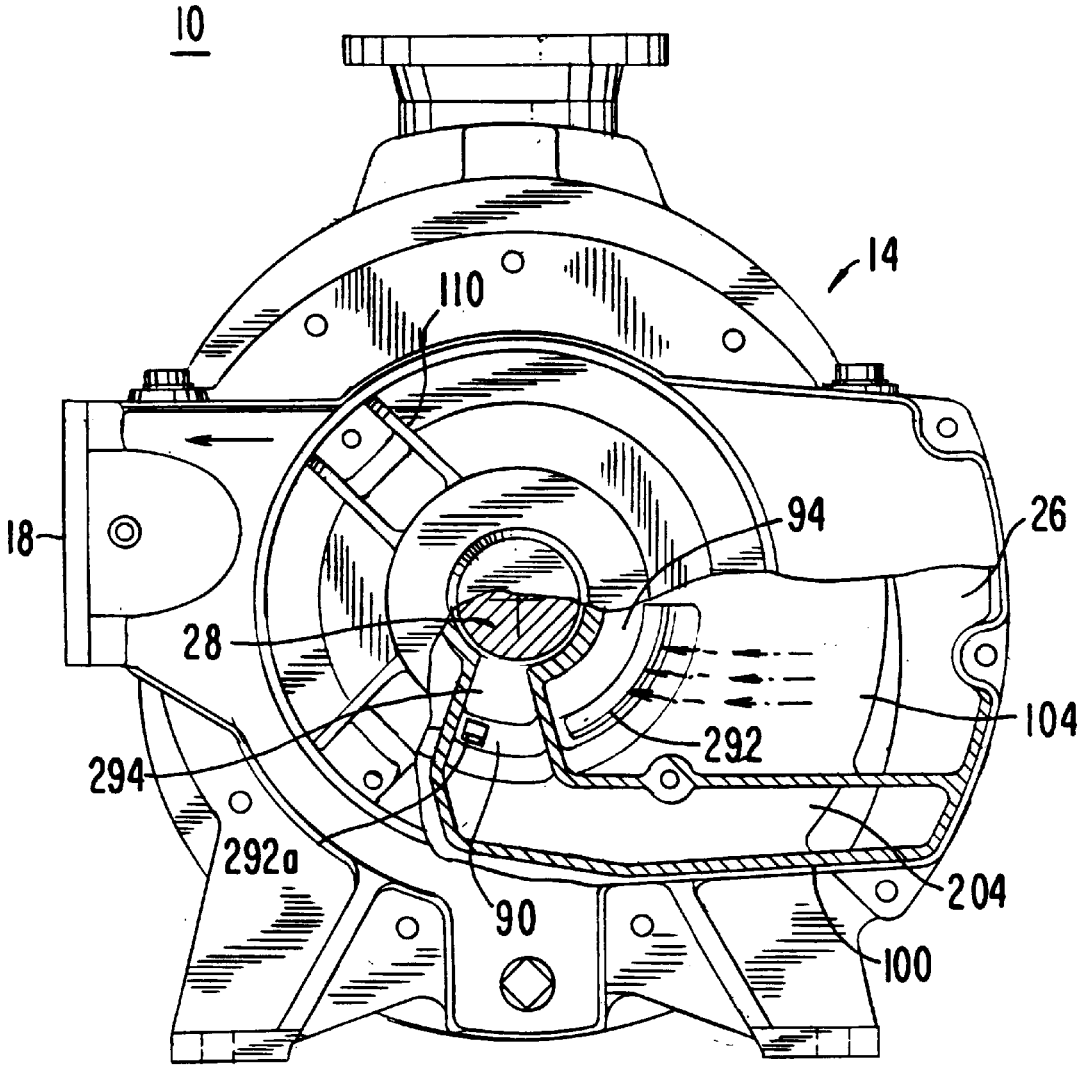
FIG. 1 is an elevational view, partly in section, of an illustrative embodiment of a two-stage liquid ring pump constructed in accordance with this invention.

Because the construction of liquid ring pumps, and even two-stage liquid ring pumps, is so well known, it will not be necessary to repeat herein a description of all the structural and operational details of such pumps. It will suffice to say that the illustrative pump 10 shown in FIGS. 1 and 2 may be basically similar to the pump shown and described in the above-mentioned Olsen et al. patent, which is hereby incorporated by reference herein. To facilitate comparison to the pump shown in the Olsen et al. patent, components of the present pump that are similar to components of the Olsen et al. pump are given the same reference numbers herein that they have in the Olsen et al. patent. Components that are new in the present pump or that are not numbered in the Olsen et al. patent have three-digit reference numbers herein that begin with the digit 2.

Figure 2:
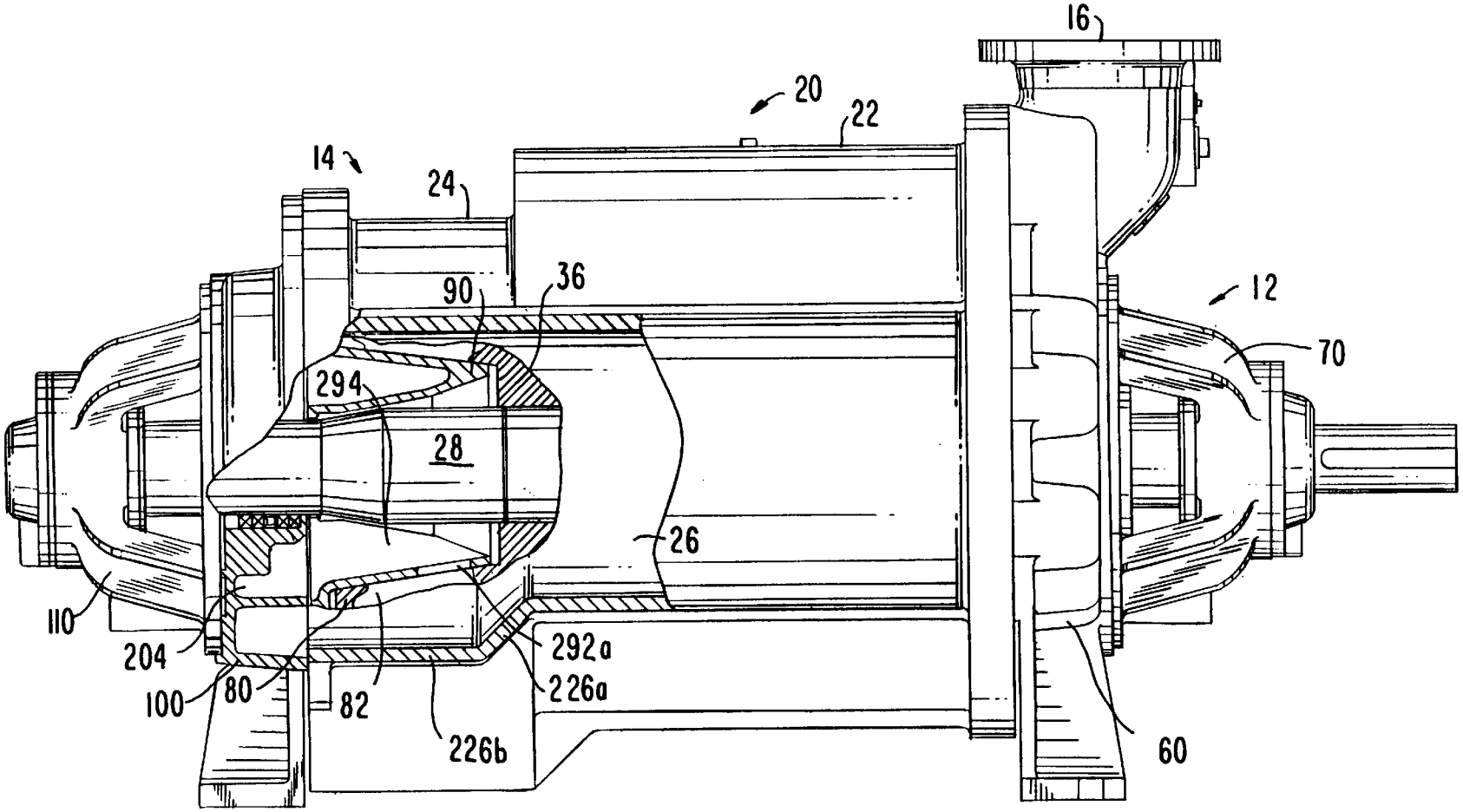
FIG. 2 is another elevational view, partly in section, of the pump shown in FIG. 1.

As viewed in FIG. 2, the first stage 12 of pump 10 is on the right and the second stage 14 is on the left. First stage 12 pumps gas from gas inlet 16 to an intermediate pressure and discharges that gas and some excess pumping liquid from the first stage via interstage conduit 26. This gas and liquid mixture flows from right to left along conduit 26 as viewed in FIG. 2.

As the gas and liquid mixture discharged from first stage 12 travels along conduit 26, the heavier liquid portion of this mixture tends to fall toward the bottom of the conduit due to the effect of gravity. The portion of conduit 26 adjacent second stage 14 has a downwardly sloping ramp 226*a* leading down to a downwardly depressed bottom portion 226*b* of the conduit. The liquid travelling along conduit 26 tends to separate from the gas and flow down ramp 226*a* into depressed lower portion 226*b*. The gas, on the other hand, tends to remain above the liquid in the upper portion of conduit 26 above depressed lower portion 226*b*.

In second stage head 100 the upper portion of conduit 26 communicates with second stage gas inlet passageway 104. Passageway 104 leads to the second stage gas inlet passageway 94 in second stage port member 90. From passageway 94 gas is pulled into the working spaces of the second stage via second stage gas inlet port 292. (Inlet port 292 is not a new feature in accordance with this invention, but it did not happen to be depicted in the above-mentioned Olsen et al. patent. Therefore, it is given a three-digit reference number in the 200 series.) Because passageway 104 communicates only with the upper portion of conduit 26, passageway 104 receives little or no liquid from conduit 26. Instead, passageway 104 receives primarily gas from conduit 26. This greatly reduces the amount of liquid entering the second stage via port 292. Choking of port 292 by liquid from conduit 26 is thereby substantially reduced or eliminated.

Instead of liquid from conduit 26 entering the second stage via port 292, completely separate liquid passageways are provided in second stage head member 100 and second stage port member 90 as will now be described. The downwardly depressed portion 226*b* of conduit 26 communicates with a liquid passageway 204 in second stage head member 100. Passageway 204 communicates with liquid passageway 294 in second stage port member 90, Passageway 294 leads to a port 292*a* in port member 90 for admitting liquid from passageway 294 into the working spaces of second stage 14 downstream (in the direction of rotation of second stage rotor blades 82) from second stage gas inlet port 292, Thus most of the liquid from conduit 26 flows down through depressed conduit portion 226*b*, passageways 204 and 294, and enters second stage 14 via a separate liquid inlet port 292*a* which is downstream from gas inlet port 292. Because liquid inlet port 292*a* is separate and downstream from gas inlet port 292, the deleterious effects in the prior art of admitting both gas and liquid to the second stage via a single inlet port are substantially eliminated. Pump performance is thereby substantially improved as compared to the prior art.

In the illustrative embodiment being described, the second stage "land" line is vertical and straight up from the central longitudinal axis of rotor shaft 28. ("Land" is the location at which the radially outer tips of rotor blades 82 come closest to the stationary housing 20 of the pump. The land line extends from the rotor shaft axis radially out to the land location.) As viewed in FIG. 1, the rotor rotates clockwise. Measuring angles from land in the direction of rotor rotation, a particularly preferred location for second stage liquid inlet port 292*a* is at about 200°, Continuing with this example, second stage gas inlet port may begin to open at about 20° and may close at about 160°. The second stage gas outlet port (not shown herein but similar to port 96 in the above-mentioned Olsen et al. patent) may open at about 258° and may close at about 340°. All of these angles are only examples and other angles may be used instead if desired.

As has been said, the following previously unmentioned components are similar to the correspondingly numbered components in the above-identified Olsen et al. patent: outlet opening 18, first stage stationary housing 22, second stage stationary housing 24, interstage shroud 36, head member 60, bearing assembly 70, annular shroud 80, and bearing assembly 110.

It will be understood that the foregoing is only illustrative of the principles of this invention, and that various modifications can be made by those skilled in the art without departing from the scope and spirit of the invention. For example, although the invention has been illustrated in the context of a pump which has frusto-conical port members such as port ember 90, the invention is equally applicable to pumps having port members with other shapes. Examples of other known shapes are cylindrical port members and flat port members. Flat port members are shown in such references is Luhmann U.S. Pat. No. 3,108,738, Fitch U.S. Pat. No. 4,132,504, Haavik U.S. Pat. No. 4,323,334, and Auschrat U.S. Pat. No. 4,685,865.

The invention claimed is:

1. A two-stage liquid ring pump comprising:

(a) a first stage including inlets for admitting gas and liquids a rotor for compressing the gas to an intermediate pressure, and an outlet for discharging a mixture of gas and liquid;

(b) an interstage structure for separating said gas in said mixture from said liquid in said mixture; and (c) a second stage including separate second stage gas and liquid inlets for respectively admitting the separated gas and liquid to said second stage.

2. The apparatus defined in claim 1 wherein said second stage has a rotor rotating in a predetermined direction, and wherein said second stage liquid inlet is downstream from said second stage gas inlet in the direction of rotation of said rotor.

3. The apparatus defined in claim 2 wherein said second stage liquid inlet is approximately 40° beyond the closing of said second stage gas inlet in the direction of rotor rotation.

* * * * *